US005194704A

United States Patent [19]

Michalski et al.

[11] Patent Number: 5,194,704

[45] Date of Patent: Mar. 16, 1993

[54] MECHANICALLY OPERATING ELECTRICAL PULSE GENERATOR

[75] Inventors: Dieter Michalski; Alfred Heeb; Hans-Georg Jost, all of Berlin, Fed. Rep. of Germany

[73] Assignee: Rudolf Schadow GmbH, Berlin, Fed. Rep. of Germany

[21] Appl. No.: 626,081

Related U.S. Application Data

[63] Continuation-in-part of Ser. No. 000,528 filed as PCT/EP88/00528 on Jun. 14, 1988.

[22] Filed: Dec. 11, 1990

[30] Foreign Application Priority Data

Jun. 14, 1988 [EP] European Pat. Off. ..... EP88/00528

[51] Int. Cl.[5] ..... H01H 21/80

[52] U.S. Cl. ..... 200/11 R; 200/24

[58] Field of Search ..... 200/1, 18, 11 R, 6, 200/400, 472, 6 R, 6 B, 6 BB, 6 C, 24, 27 R, 28, 179, 21; 368/90-100, 148, 210-219

[56] References Cited

U.S. PATENT DOCUMENTS 4,395,604 6/1981 Tominaga ..... 360/85

4,652,947 5/1983 Oka et al. ..... 200/74

FOREIGN PATENT DOCUMENTS 0202495 11/1986 European Pat. Off. .

0229306 7/1987 European Pat. Off. .

*Primary Examiner*—A. D. Pellinen

*Assistant Examiner*—Michael A. Friedhofer

*Attorney, Agent, or Firm*—Thomas L. Peterson

[57] ABSTRACT

A mechanically operating pulse for generating electrical pulses dependent upon the rotation of direction of rotary shaft. The pulse generator includes a gear rim having internal toothing driven by the rotary shaft, a radially and generally deflectable switching sleeve which has a cam which engages in a tooth space of the gear rim. A spring member supports the switching sleeve on its side opposite the cam. Metal contacts are disposed adjacent to end areas of the spring member in such a way that said end areas are movable into contact with the metal contacts. A contact stud is disposed centrally of the spring member such that it mechanically retentions it in such a way that each end area is pressed against its adjacent metal contact and the cam is pressed into a tooth space of the gear rim. When the rotary shaft is rotated by one tooth, an end area of the spring member is moved into or out of contact with its adjacent member.

14 Claims, 2 Drawing Sheets

MECHANICALLY OPERATING ELECTRICAL PULSE GENERATOR

CROSS REFERENCE TO RELATED APPLICATION

This application is a continuation of PCT Application Number PCT/EP88/00528, designating the United States and filed Jun. 14, 1988.

BACKGROUND OF THE INVENTION

A mechanically operating pulse generator for producing electrical pulses depending on direction of rotation is described in EP-A 229 306. It has a contact tongue movable between a pair of metal contacts for each direction of rotation. Depending on the direction of rotation, either one or the other contact tongue is actuated by a switching sleeve whose cam engages in a gear wheel. The gear wheel is toothed on the outside, and is moved and pressed into the inter-tooth recesses of the gear wheel when the gear wheel rotates.

Manufacturing of this device is, however, too complex. Thus the problem underlying the invention, and a task to be performed, is to devise a mechanically operating pulse transmitter for producing electrical pulses which is as simple as possible in construction — i.e., which is composed and manufacturable in as simple a manner as possible. Also, the device should be compact and hence space-saving in construction and be suitable for automatic mass production.

BRIEF DESCRIPTION OF THE INVENTION

In the present invention, this is achieved by, among other things, the fact that use is made of a rotatable gear rim with internal teeth. The cam of a switching sleeve engages the internal teeth and the cam is supported on a spring member whose ends are in turn moved by the switching sleeve between a pair of metal contacts disposed adjacent the ends thereof.

One of the resultant advantages is the saving of the two contact tongues used in the prior art device, as the spring member in the invention takes over their functions. The toothed gear system included in the prior art device is also eliminated, as the gear rim in the invention is driven directly by the rotating shaft, so that a largely centrosymmetrical construction of the pulse generator is achieved.

THE DRAWING

The invention will now be explained in greater detail with reference to the figures of the drawing, in which:

FIG. 1 shows a preferred embodiment of the invention in an exploded perspective presentation and FIGS. 2(*a*) - (*c*) show, schematically, a plan view of the position of the individual parts of the pulse generator in three characteristic switching positions.

DETAILED DESCRIPTION

Figure 1:
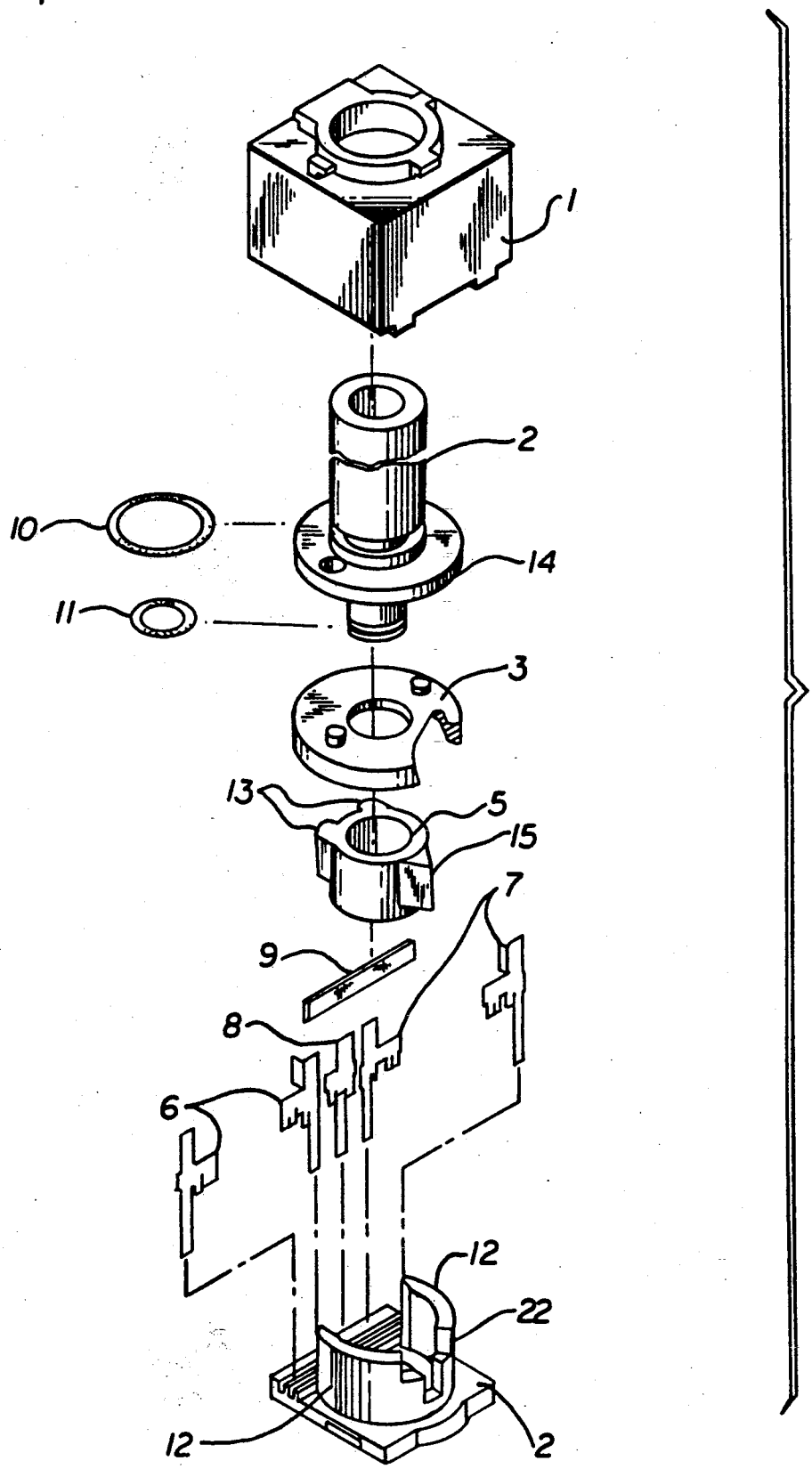

FIG. 1 is an exploded perspective view of a mechanical pulse generator embodying the present invention. The pulse generator has a housing formed of a lower housing part 2 and an upper housing part 1. The lower housing part 2, which may be a prefabricated molded plastic part, has holes in its baseplate for receiving pairs 6, 7 of metal contacts and also a contact pin 8, which is or has been inserted approximately in the middle between the two pairs 6, 7. Lugs of these contacts, which can be seen in FIG. 1, project from the pulse generator on the lower side of the baseplate, while on its upper side they are formed so as to make a contact with, in each case, an end area of a spring member 9. For this purpose the metal contacts and the contact stud 8 comprise appropriately curved prolongations, so that linear contact-making with the spring member can be achieved.

The lower housing part 2 has two stops 12, which are disposed concentrically relative to the external curvature of the switching sleeve 5. The cam 15 of the switching sleeve can impinge in each case against an upper face 22 of an associated stop 12.

The switching sleeve 5 has a bore for receiving rotary shaft 4, the diameter of this bore being so selected so that the cam can jump from tooth space to tooth space on the internally toothed gear rim 3 when the latter is turned by the rotary shaft 4. The diameter of the bore is thus greater than the diameter of the rotary shaft 4, as can be clearly seen in FIGS. 2(*a*)-(*c*).

The gear rim 3 is installed on the rotary shaft 4 and includes two follower pins which fit into corresponding holes in the flange 14 of the rotary shaft 4. Thus, viewed from the flange 14, there is installed first — with the interposition of a washer 11 — the gear rim 3 and then the switching sleeve 5. On the side of the flange 14 facing away from the gear rim 3 there is placed on, finally, the upper housing part 1 with the interposition of a washer 10. The upper housing part 1, by suitable shaping, e.g., projections etc., can be joined with the lower housing part 2 by a snap action.

Figures 2A, 2B, 2C:
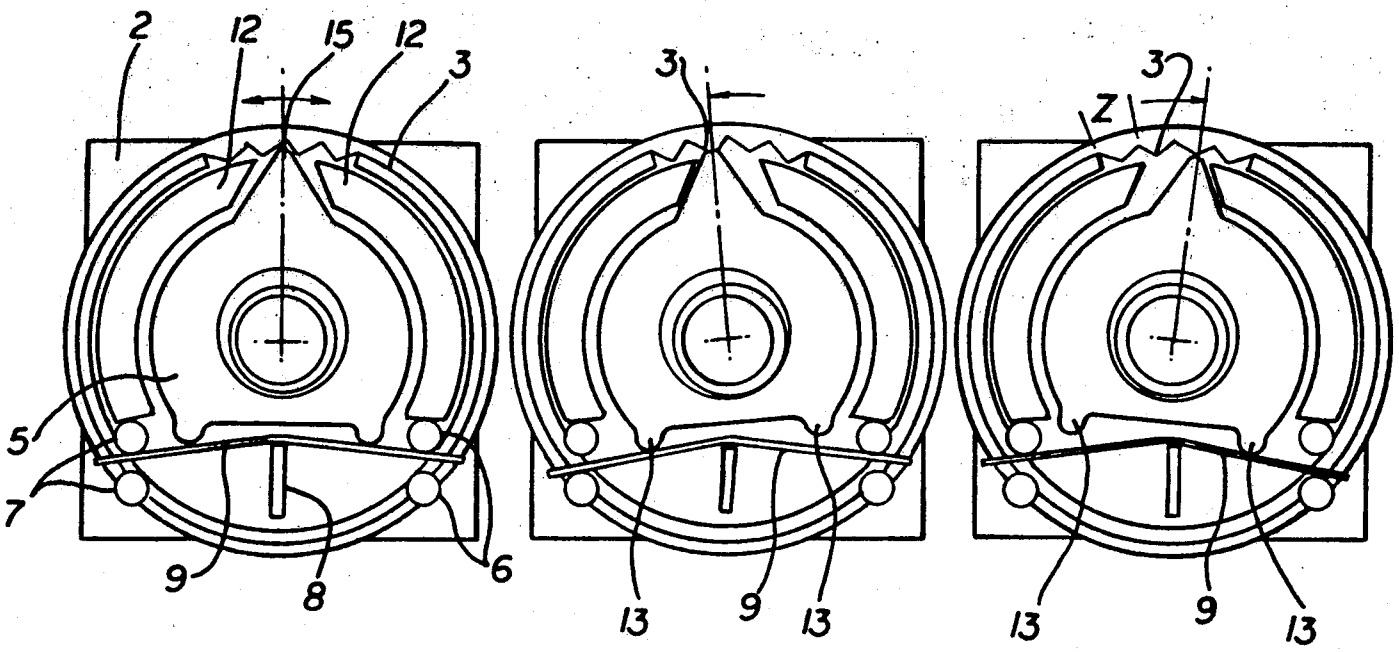

In the assembled state, the switching sleeve 5 is supported on its side opposite to the cam 15, by means of the two projections 13, and spring member 9. The projections 13 are engaged by the spring member 9, as shown in FIG. 2(*a*). The projections 13 are in contact with the spring member 9, the end areas of the spring member 9 make contact with the inner metal contact (the upper contact in FIG. 2(*a*)) of each pair 6, 7. By the spring action of the spring member 9, which, for instance, is straight in the untensioned state and, in the assembled state, is under slight mechanical pretensioning owing to the position of the projections 13 and the contact stud 8, the cam 15 is pressed into a tooth space of the gear rim 3, so that the bore of the switching sleeve 5 lies against the underside of the rotary shaft 4.

FIG. 2(*b*) shows the position of the switching sleeve 5 and the spring member 9 when the gear rim 3 is turned to the left. The cam 15 is then moved to stop 12 and thus the projection 13 on the left-hand side of the switching sleeve 5 presses the left-hand end area of the spring member 9 from the upper (or inner) metal contact of the pair 7 against the lower (or outer) contact. When the gear rim 3 is turned further, the cam 15 jumps into the next tooth space and thereby causes the left-hand end area of the spring member 9 to jump again against the upper (inner) metal contact of the pair 7. Therefore, when the rotary shaft 4 is turned to the left, this brings about a constant upward and downward movement of the left end area of the spring member 9 and alternating contact-making with the upper and the lower metal contacts of the pair 7. This mechanical movement can be electrically utilized, for instance, by applying a power source to the contact stud 8. Then, upon rotation to the left, pulse sequences can be obtained from either the upper or the lower stud, these pulse sequences being approximately inverse to each other.

FIG. 2(*c*) shows, as a counterpart to FIG. 2(*b*), the position of the switching sleeve 5 and the spring member 9 when the rotary shaft 4 and thus the gear rim 3 are turned to the right. In this case, too, the cam 15 is turned as far as the right-hand stop 12, so that now the right-hand projection 13 moves the right-hand end area of the spring member 9 up and down between the two metal contacts of the pair 6 as the shaft 4 rotates to the right.

Thus again, when an external power source is connected to the contact stud 8, it is possible upon rotation to the left, as mentioned, to take two pulse sequences which are practically inverse in relation to each other from the metal contact pair 7, while upon rotation of the rotary shaft 4 to the right, two pulse sequences which are inverse to each other likewise appear at the metal contact pair 6. It is thus possible, with the pulse generator, to generate electrical pulses dependent on the direction of rotation.

Although FIGS. 2(*a*)–(*c*) serve to explain the method of operation of the pulse generator according to the invention, it can nevertheless be seen from the figures that the distance between the two metal contacts of each pair 6, 7, the width of the switching sleeve 5 and the tooth height of the gear rim 3 and the position of the contact stud 8 which determines the pretensioning of the spring member 9 must be chosen in such a way that, when the rotary shaft 4 is turned by one tooth, either the one or the other end area of the spring member 9 is pressed away from one metal contact of the one pair against the other metal contact of this pair and back again. This dimensioning of the individual members and components is well within the skill of a person skilled in this technology.

We claim:

1. Mechanically operating pulse generator switch for (generating electrical pulses) operating electrical contacts dependent on direction of rotation of a rotary shaft, said generator switch comprising:

a) a gear rim (3) with internal toothing driven by said rotary shaft (4);

(b) a deflectable switching sleeve (5) which has a cam (15) which engages in a tooth space of the gear rim (3);

(c) a spring member (9) for supporting the switching sleeve (5) on its side opposite to the cam, (15);

(d) contact means disposed adjacent two end areas of the spring member (9), in such a way that said end areas are movable into contact with said contact means; and (e) a contact stud (8) disposed in a central area of the spring member (9) and mechanically pretensioning said spring in such a way that the cam (15) is pressed into a tooth space of the gear rim (3) and such that when the rotary shaft (4) is rotated by one tooth, one of the end areas of the spring member (9) is moved in and out of contact with its adjacent contact means thereby operating the electrical contacts formed by said contact means and said contact stud.

2. Pulse generator switch as claimed in claim 1, wherein said contact means comprise a pair of metal contacts disposed adjacent each of said end areas of said spring member (9) such that when the rotary shaft (4) is rotated by one tooth, one of the end areas of the spring member (9) is moved out of contact with a first one of said pair of contacts and temporarily into contact which a second one of said pair of contacts, and thereafter returns again into contact with said first one of said pair of contacts.

3. Pulse generator switch as claimed in claim 2, wherein the particular pair of contacts with respect to which an end area moves in response to rotation of the shaft depends upon the direction of rotation of said shaft.

4. Pulse generator switch as claimed in claim 1 with a switching sleeve (5) pivoted on the rotary shaft (4) in a rotatably and radially deflectable manner.

5. Pulse generator switch as claimed in claim 4 wherein said switching sleeve includes two projections (13), both of which bear against said spring member (9) when said switch is in an at rest position and wherein only one of said projections is in contact with said spring member (9) when said switching sleeve is being deflected as its cam (15) rides upon the teeth of said gear rim (3).

6. Pulse generator switch as claimed in claim 1, further including a lateral stop (12) for limiting rotational movement of said switching sleeve to a distance equal to one tooth division of said gear rim (3).

7. Pulse generator switch as claimed in claim 6, wherein said lateral stop (12) is molded into the lower housing part (2).

8. Pulse generator switch as claimed in claim 1, wherein said switching sleeve (5) includes a projection (13) associated with each end area of said spring member (9).

9. Pulse generator switch as claimed in claim 8, wherein each of said projections (13) engages said spring member (9) between the contact stud (8) and the contact means adjacent the ends thereof.

10. Pulse generating switch as claimed in claim 1, wherein one end of said spring member makes alternate contact with contact means exposed adjacent one end thereof in response to rotation of said rotary shaft in a given direction and makes alternate contact with contact means exposed adjacent a second end thereof in response to rotation of said rotary shaft in the opposite direction.

11. A pulse generator switch for generating electrical pulses when coupled to a source of electrical energy in a response to the rotation of a rotary shaft, said generator switch comprising:

(a) a member concentrically disposed about said shaft;

(b) means for radially and tangentially deflecting said member in response to rotation of said shaft;

(c) a spring member for supporting said member in engagement with said shaft;

(d) first and second electrical contact means disposed adjacent an end of said spring member, said spring member contacting said first electrical contact mean when said member is in an at rest position and contacting said second electrical contact means when said member is radially and tangentially deflected by said deflecting means in response to rotation of said shaft in a first direction; and (e) a third contact means in contact with said spring member whereby ohmic contact is made alternatingly between said third contact means and said first and second contact means in response to rotation of said rotary shaft.

12. The pulse generator switch of claim 11, further including fourth and fifth contact means disposed adjacent a second end of said spring member, said spring member being brought into alternating contact with said fourth and fifth contact means in response to rotation of said rotary shaft in a second direction.

13. A pulse generator switch for generating electrical pulses when coupled to a source of electrical energy and in a response to the rotation of a rotary shaft, said generator switch comprising:

(a) a member concentrically disposed about said shaft;

(b) means for radially and tangentially deflecting said member in response to rotation of said shaft;

(c) a spring member for supporting said member in engagement with said shaft;

(d) first and second electrical contact means disposed adjacent an end of said spring member, said end of said spring member alternatingly contacting said first and second electrical contacts in response to rotation of said shaft in a first direction; and (e) a third contact means in contact with said spring member.

14. The pulse generator switch of claim 13, further including fourth and fifth contact means disposed adjacent a second end of said spring member, said spring member being brought into alternating contact with said fourth and fifth contact means in response to rotation of said rotary shaft in a second direction.

* * * * *